US008063311B2

(12) United States Patent
Fernandez et al.

(10) Patent No.: US 8,063,311 B2
(45) Date of Patent: Nov. 22, 2011

(54) INSULATOR FOR ELECTRIFIED ELEMENTS

(76) Inventors: Eduardo Roberto Fernandez, Pcia. de Buenos Aires (AR); Cesar Hugo Olivera, Ciudad de Buenos Aires (AR)

( * ) Notice: Subject to any disclaimer, the term of this patent is extended or adjusted under 35 U.S.C. 154(b) by 126 days.

(21) Appl. No.: 12/486,675

(22) Filed: Jun. 17, 2009

(65) Prior Publication Data

US 2010/0236816 A1 Sep. 23, 2010

(30) Foreign Application Priority Data

Mar. 16, 2009 (AR) ..... P20090100923

(51) Int. Cl.
*H01B 17/16* (2006.01)

(52) U.S. Cl. ..... 174/168; 174/167; 174/184; 174/165; 174/208; 254/199

(58) Field of Classification Search ..... 174/184, 174/207, 137, 167, 165, 208, 168; 254/199
See application file for complete search history.

(56) References Cited

U.S. PATENT DOCUMENTS

| | | | | | |
|---|---|---|---|---|---|
| 1,185,700 | A * | 6/1916 | Moss | ..... | 174/162 |
| 1,578,526 | A * | 3/1926 | Jackson | ..... | 174/208 |
| 1,824,767 | A * | 9/1931 | Barrow | ..... | 174/207 |
| 5,568,132 | A * | 10/1996 | Pratt | ..... | 340/657 |

* cited by examiner

*Primary Examiner* — Dhirubhai R Patel
(74) *Attorney, Agent, or Firm* — Amin Talati, LLC; Paul L. Brown; Janine A. Moderson

(57) ABSTRACT

An insulator member includes a set of passages (2) (4) which, without intercrossing, extend through the main body (1a) of the insulator member. The set of passages (2) (4) includes an insulating passage (2) structurally arranged to be engaged by filiform elements (10) and an elongated anchor passage (4) structurally arranged to be engaged by the hook portion (21) of the stretcher device (20). Since the passages (2) (4) do not intercross, the separating portion (1d) prevents the stretched filiform elements from being subject to compression upon stretching of the stretching device.

13 Claims, 5 Drawing Sheets

INSULATOR FOR ELECTRIFIED ELEMENTS

BACKGROUND OF THE INVENTION

1. Field of the Invention

The present invention is related to the field of construction structures, such as fences, wiring or any other containing electrified filiform elements and susceptible to stretching, as well as to the field of insulators particularly characterized for their use with such construction structures.

More particularly, the present invention relates to an insulator member for electrified filiform elements having a main body that is reduced in size, that possesses an elongated passage for engagement with a stretching hook and which prevents the intercrossing of the insulating and anchor passages within the insulator member.

2. Prior Art

At the present time, several insulator members are known which are comprised of various insulating materials, and are used to engage the electrified filiform elements with stretcher devices that allow their fixation and stretching.

For example, the U.S. Design Patent 5,356,165 discloses a structure wherein there is an elongated cross-shaped opening component surrounded by thin walls. Due to this weakened configuration, this structure gives way and is distorted when subject to stretching. In addition, its traction end adjacent to the opening is not shaped to be engaged by a hook stretcher. Also, the disclosed structure does not have insulating fences to protect the electrified filiform conductor.

The document U.S. Pat. No. 4,061,873 shows a complex insulator that operates in a different manner and which structure is very fragile.

The insulator members disclosed by documents AR-P040101190, U.S. Pat. No. 7,406,752 and AR-P050100600, by the same inventors of the present invention, are of small sized insulator members that may be engaged with the hook type openings of a stretcher device. However, these insulator members have intercrossed or overlapping passages that subject the intermediate part of its structure to compression.

In general, most of the known insulators have intercrossed or overlapping passages, which cause a separation to form during compression efforts. This results in extremely dangerous conditions when dealing with electrified conductors because as environmental conditions deteriorate, the insulating structure, especially when composed of plastic materials, tends to break and cause short circuits or electric conduction in parts that should be insulated.

Also known are insulator members that are provided with throats for the electrified conductors, however, most of these structures have their passages intercrossed, work at compression and are very bulky.

SUMMARY OF THE INVENTION

One advantage of the present invention is an insulator member having a structure structurally arranged to relate efficiently with stretcher devices having an engagement hook.

Another object of the present invention is to provide an insulator member having a small structure able to work at traction.

Another advantage of the insulator member is that it has an elongated anchor passage combined with a first traction portion which allows engagement with the flat hook portion of a stretcher device on which anchor bottom, fits the above mentioned traction portion.

A further advantage of the insulator member is that it has an insulating passage and an elongated anchor passage which permits the present insulator member and its two passages to both be engageable with filiform elements and a stretching device, respectively.

Another advantage is that the insulating and elongated anchor passages are not intercrossed or overlapping, a structure that prevents the separating portion to be subject to compression efforts. This structure prevents, particularly in the case of a plastic material insulator, that any damages due to environmental conditions combine with the compression efforts to cause a breaking of the above mentioned separating portion, which would produce a short circuit or electric conduction in parts which usually should be insulated.

A further advantage is that the presence of the insulating fences or wall and the thickening edges permits obtaining an insulator member having a main body which is not bulky in size while maintaining structural resistance and integrity during usage.

Another further advantage is that, having a flat main body, the separating portion has its structural resistance capacity to traction reinforced by the supplementary action of the lateral rims of the main body of the insulator member.

Another advantage is that the higher height of the insulating fences or walls, in relation to the thickening edges, ensures an adequate insulation of the electrified conductors, which remain adequately arranged within the channeling throats and without any possibility of accidental contact with the anchor hook that goes through the elongated anchor passage or opening.

Another advantage of the present invention is that the insulator may be comprised of any insulating material. For example, materials like ceramics, POM nylon (Polyoximethilene), acetal resin and/or any other material suitable for that purpose may be used.

Another advantage is that because the two passages or openings, insulating and elongated anchor, are open on the same faces of the main body, the placement operations are easier because the insulator must not be turned around to connect the filiform elements and the stretcher hook.

DESCRIPTION OF THE DRAWINGS

For understanding the objects of the present invention, the present invention is illustrated in several drawings wherein it has been represented in one of its preferred embodiments, in an illustrative manner but not with limitation.

In the different figures, the same numbers and/or reference letters indicate the same or corresponding parts.

Figure 1:
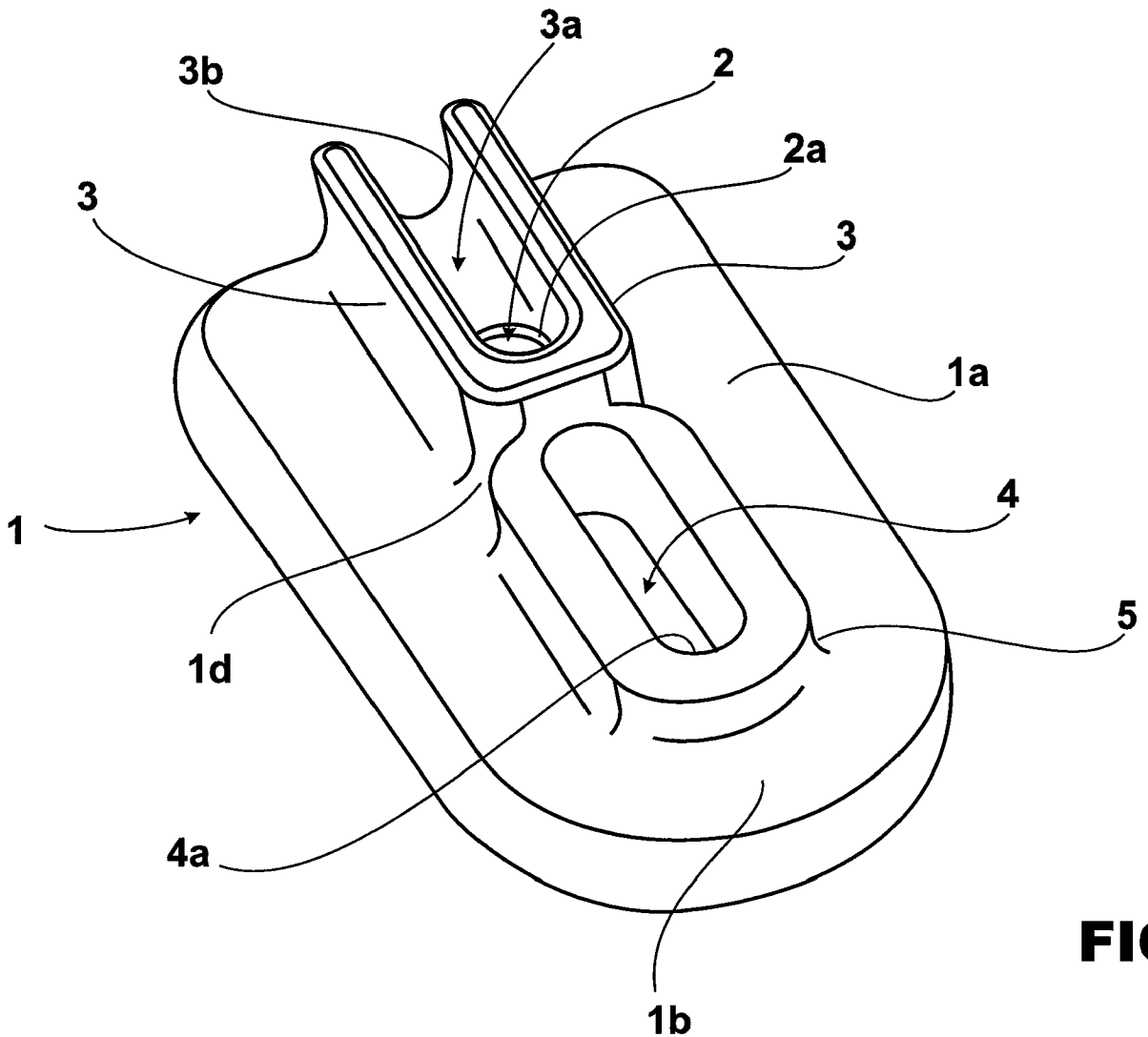
FIG. 1 is a perspective view of the present insulator member which allows appreciating its constitution and components.
Figure 3:
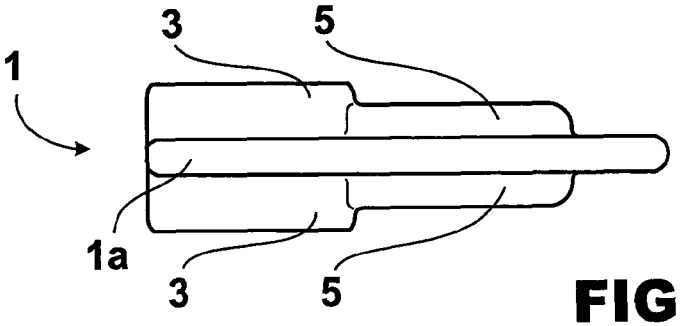
FIG. 3 is a lateral, elevated view of the insulator member of FIG. 1, illustrating the flat main body as well as the form in which, from the latter, the thickening edged and the insulating fence or walls are projected at different heights.
Figure 2:
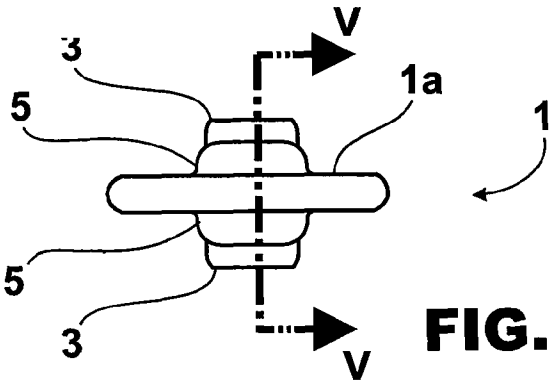
FIG. 2 is a front elevated view of the insulator member of FIG. 1.
Figure 5:
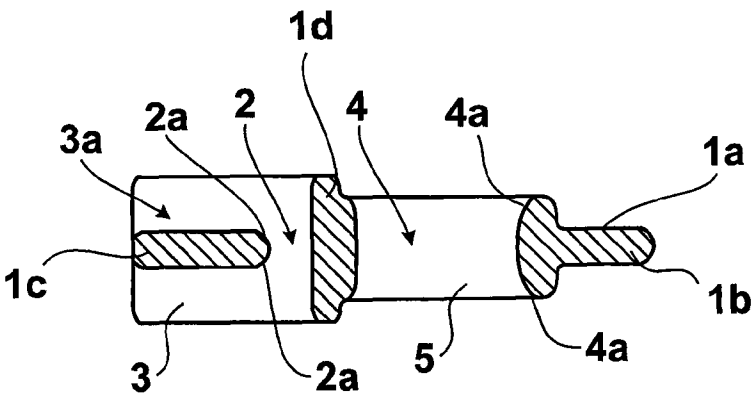
FIG. 5 is a longitudinal section of the insulator member according to a section plane indicated as V-V in FIG. 2. The section allows observing the passages or openings as well as the traction and separating portions of the main body.
Figure 4:
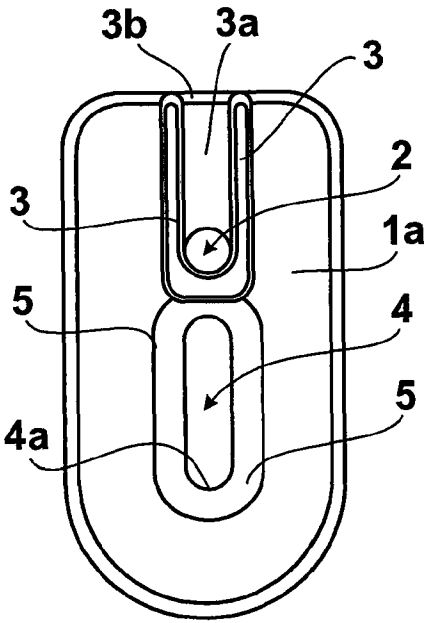
FIG. 4 is a plan upper view of the insulator member of FIG. 1, illustrating that the elongated configuration of the anchor passage permits engagement with the stretcher hook.
Figure 7:
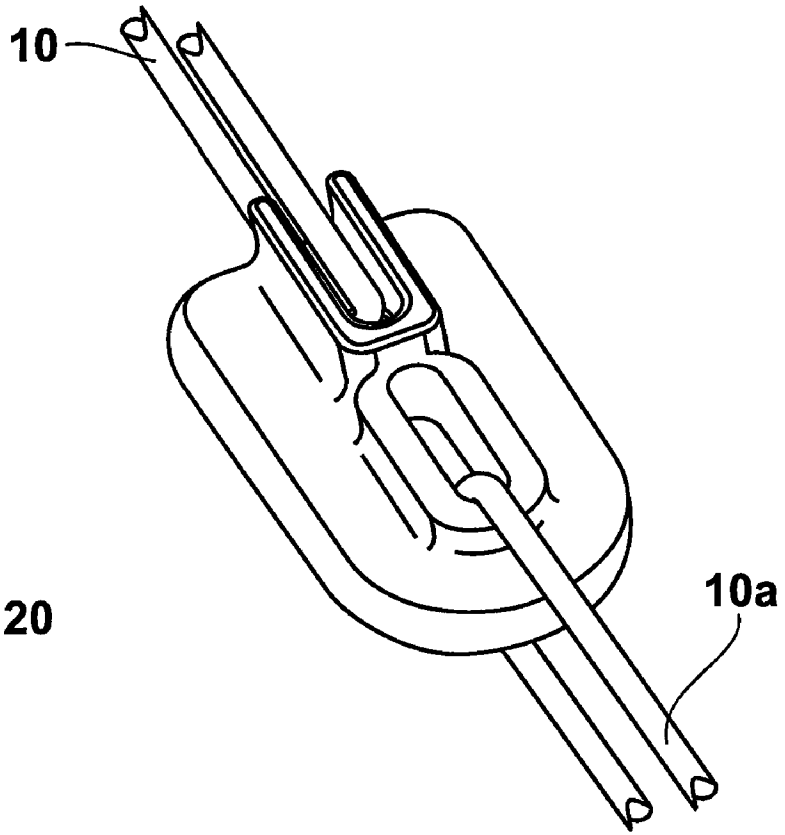
FIG. 7 is another perspective view illustrating how the present insulator is also suitable for conventional use, relating electrified wires with stretcher wires.
Figure 6:
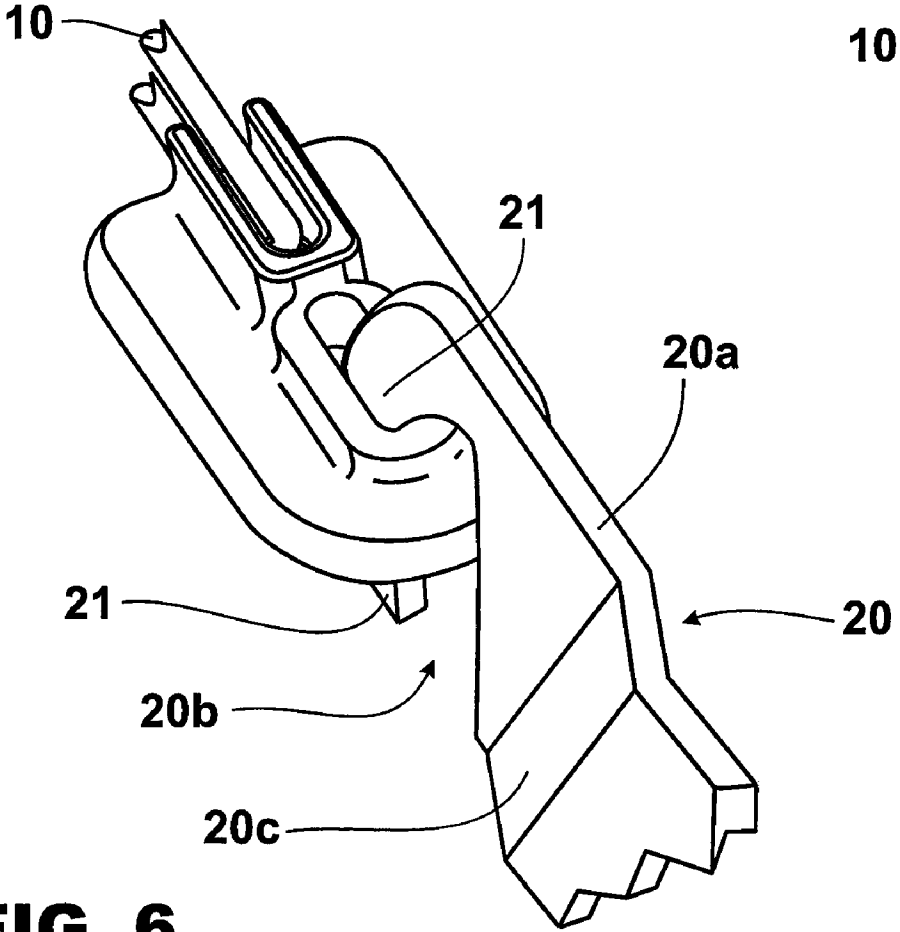
FIG. 6 is a perspective view wherein it can be observed how the present insulator allows the anchorage of the flat stretcher hook.
Figure 8:
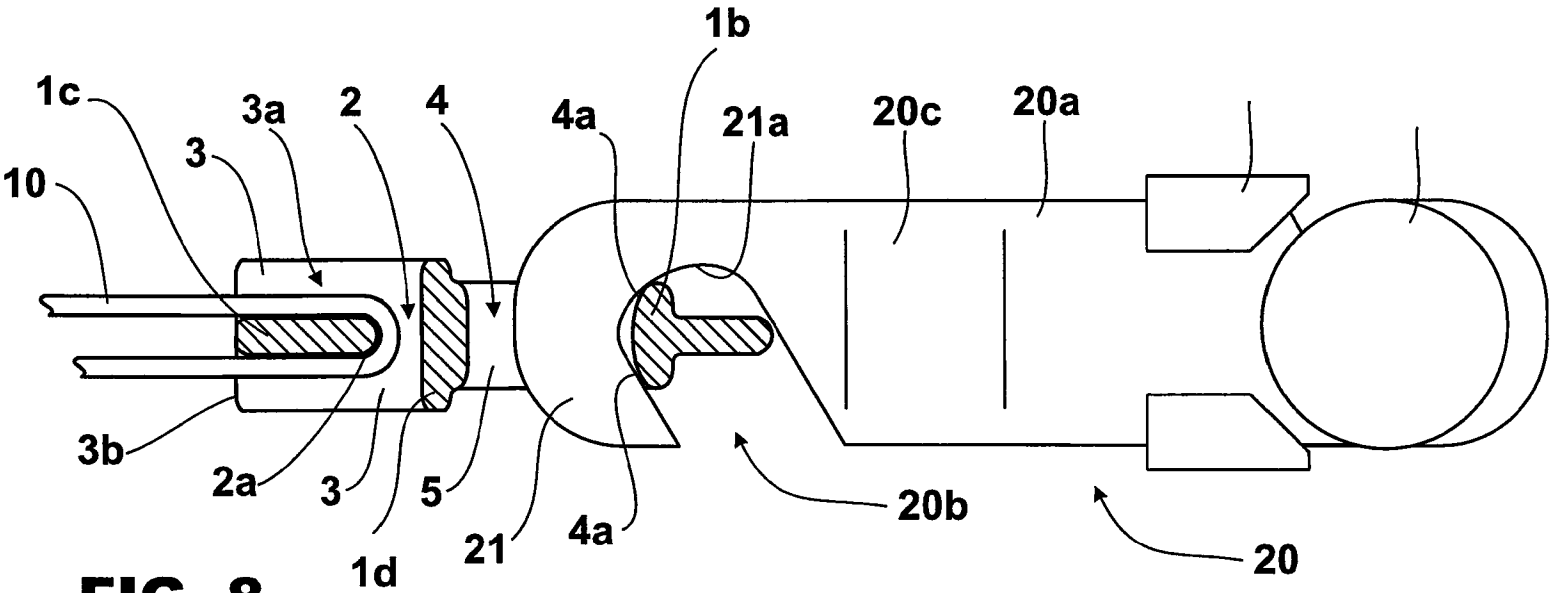
FIG. 8 is another longitudinal section of the insulator member which illustrates in detail the insulator's relation with the hook of a stretcher, on the one hand, and with an electrified wire, on the other.
Figure 9:
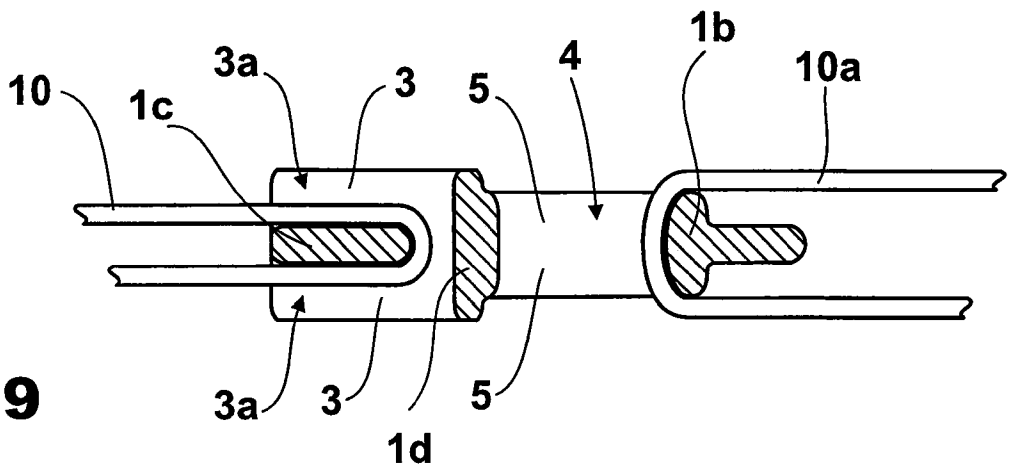
FIG. 9 is another longitudinal section of the insulator member which illustrates in detail the insulator's use in which it is related to a stretched wire, on the one hand, and with an electrified wire, on the other.
Figure 10:
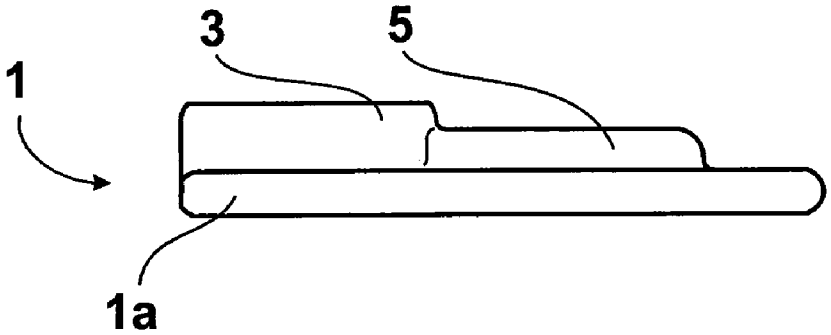
FIG. 10 is a lateral, elevated view of the insulator member in another embodiment in which the insulating fence and the thickening edge outstand from only one face of the main body.
Figure 11:
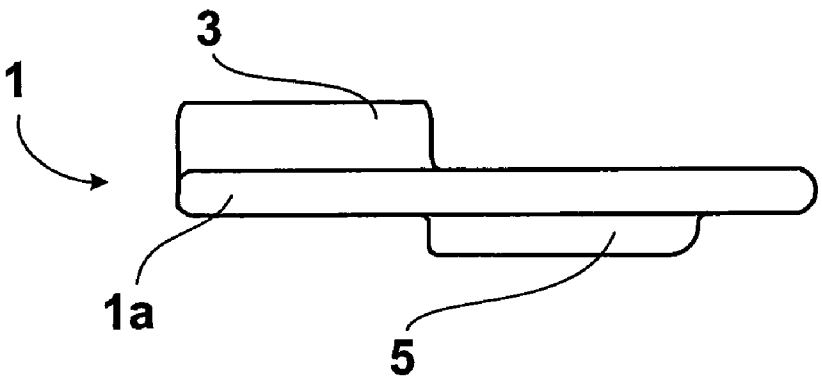
FIG. 11 is a lateral, elevated view of the insulator member in another embodiment in which the insulating fence and the thickening edge outstand from opposite faces of the main body.

REFERENCE NUMBERS IN DRAWINGS (1) Insulator member.
(1*a*) Main body of the insulator member (1).
(1*b*) First traction portion [of the main body (1*a*)].
(1*c*) Second traction portion [of the main body (1*a*)].
(1*d*) Intermediate separating portion [of the main body (1*a*)]
(2) Insulating passage.
(2*a*) Insulating outlet of the insulating passage (2).
(3) Insulating fence.
(3*a*) Channeling throats formed by the insulating fence (3).
(3*b*) Channeling access opening to the throat (3*a*).
(4) Elongated anchor passage.
(4*a*) Outlet rims of the anchor passage (4).
(5) Thickening edges.
(10) Electrified filiform elements.
(10*a*) Anchor filiform elements.
(20) Stretcher device.
(20*a*) Flat stretcher main body (20).
(20*b*) Anchor or connection opening.
(20*c*) Alignment transverse ply of the main body (20*a*).
(21) Anchor hook.
(21*a*) Anchor bottom of the anchor opening (20*b*).

DETAILED DESCRIPTION

In general terms, the present invention refers to an insulator member (1) for electrified elements which comprise a set of passages or openings (2) (4) that, without intercrossing or overlapping, extend through the main body (1*a*) of the insulator. This set of passages (2)(4) comprises an insulating passage (2) ready to be passed through by filiform elements (10) and an elongated anchor passage (4) ready to be passed through by the hook (21) of a stretcher device (20).

More particularly, the present insulator (1) is applicable to electrified wirings and is intended to serve as an insulating relation between filiform elements (10)—such as wires, ropes, threads, wires and any other equivalent element—and stretcher devices (20) having a flat main body (1*a*) and an anchor opening (20*b*) in the shape of a hook (21).

This insulator (1) comprises a main body (1*a*) made of an electrically insulating material (FIG. 1), such as ceramics, POM nylon (Polyoximethilene), acetal resin and/or any other suitable material for that purpose.

In one possible embodiment, the insulator member (1) is provided with a set of passages or openings (2) (4) that extend through the main body (1*a*). This set of passages (2) (4) comprise an insulating passage (2) and an elongated anchor passage (4).

The insulating passage (2) extends through the main body (1*a*) opening outside through each insulating outlet (2*a*) situated on its ends. Around the above mentioned insulating outlets (2*a*) are positioned insulating fences (3) which extend as far as the end of the main body (1*a*), so that they form a channeling throat (3*a*) for the electrified filiform element (10) (FIGS. 1-5).

In addition, the elongated anchor passage or opening (4) extends through the main body (1*a*) opening outside through each outlet rims (4*a*) situated on its ends. This elongated anchor passage (4) prolongs beyond the main body (1*a*) through each thickening edges (5).

The insulating fences (3) as well as the thickening edges (5) may project from one of the faces of the main body (1*a*), from both faces or from opposite faces. For example, the insulating fence (3) outstanding from one face of the main body (1*a*) and the thickening edge (5) may be outstanding from the opposite face.

Mainly, the above mentioned elongated anchor passage (4) has been created to be engaged with the anchor hook (21) of the flat anchor of a stretcher device (20). In addition, the outlet edges (4*a*) are structured so that said anchor hook (21) may engage the first portion (1*b*) of the main body (1*a*), which fits in the bottom (21*a*) of the anchor opening (20*b*) of the hook (21).

Thus, an embodiment has been considered in which the insulating fences (3) are higher than the thickening edges (5). In this manner, the passages (2) (4) that extend through the main body (1*a*) define in its structure, a first traction portion (1*b*) to one side, a second traction portion (1*c*) to the opposite side and an intermediate separating portion (1*d*) of the passages. With this arrangement, the above mentioned separating portion (1*d*) is not subject to compression.

In the embodiment described, the two passages (2) (4) open on the same faces of the main body (1*a*) so that both passages (2) (4) are simultaneously exposed if they are observed from the same observation point.

Operation:

The presence of the elongated anchor passage (4) is structurally arranged to allow receipt of the anchor hook (21) on the flat stretcher device (20). The thickening edges (5) allow, on the one hand, increasing the structural resistance of the main body (1*a*) in that sector and, on the other hand, that the outlet edges (4*a*) of the first traction portion (1*b*) fits suitably into the bottom (21*a*) of the anchor hook (21).

The insulating fence (3) not only allows increasing the structural resistance of the main body (1*a*) in that sector, but it ensures the insulation of the electrified filiform element (10) and its adequate arrangement into the channeling throats (3*a*) as far as its outlet through the respective intercrossing opening (3*b*).

Because the passages (2)(4) do not intercross, this prevents that the separating portion (1*d*) from being subject to the compression due to the stretching action of the filiform element (10) and the hook (21) of the stretcher device (20). In these conditions, the referred hook (21) subjects to traction the first traction portion (1*b*), whereas the electrified filiform element (10) subjects to traction the second traction portion (1*c*).

Finally, it is relevant to mention that the presence of the insulating fences (3) and thickening edges (5) provide the insulator member with a structural resistance that permits the main body (1*a*) to possess a lower mass without decreasing the structural resistance or the insulating capacity of the insulator member.

When the present invention is in practice, modifications may be introduced regarding certain construction details and form, without leaving the essential principles that are explained in the claims below:

We claim:

1. An insulator member for providing an insulating relation between filiform elements, including wires, ropes, threads, and cables and a hook-shaped filament stretcher device comprising:

a main body made of electrically insulating material having two side facings;

a set of separate passages structurally arranged in said main body to engage said filiform elements and said hook-shaped filament stretchers device; and wherein said set of separate passages, without intercrossing, extend through said main body, with said set of separate passages including at least one insulating passage having outlets structurally arranged to receive said filiform elements; and at least one elongated anchor passage to receive said hook-shaped filament stretcher device.

2. The insulator member in accordance with claim 1, wherein said set of separate passages, without intercrossing, are positioned on opposite side facings of said main body.

3. The insulator member in accordance with claim 2, wherein said main body includes on one side facing thereof an insulating fence extending outwardly therefrom and on the other side facing, a thickening edge extending outwardly therefrom.

4. The insulator member in accordance with claim 1, in which said at least one of the passages includes an insulating fence extending about said outlets of said insulating passage.

5. The insulator member in accordance with claim 1, wherein said set of separate passages includes insulating fences about said outlets on both sides of said main body to form a channeling throat for said filiform elements.

6. The insulator member in accordance with claim 1, wherein said separate passages includes thickening edges therearound.

7. The insulator member in accordance with claim 1, wherein said insulating passage includes an insulating fence and said elongated anchor passage includes a thickening edge therearound.

8. The insulator member in accordance with claim 1, wherein said main body is flat on both side facings and, an insulating fence and a thickening edge extends outwardly, with said insulating fence being higher than said thickening edges.

9. The insulator member in accordance with claim 1, wherein said elongated anchor passage includes an outlet edge structurally arranged to receive said hook-shaped stretcher device.

10. The insulator member in accordance with claim 1, which is composed of an insulating plastic material.

11. The insulator member in accordance with claim 1, which is composed of an insulating ceramic material.

12. The insulator member in accordance with claim 1, wherein said set of separate passages open on the same side faces of said main body.

13. The insulator member in accordance with claim 1, wherein said set of separate passages pass through said main body without intercrossing to provide a first traction portion of traction towards one side, a second traction portion towards the other side and an intermediate separating portion of the passages.

* * * * *